US005371991A

United States Patent [19]

Bechtel et al.

[11] Patent Number: 5,371,991

[45] Date of Patent: * Dec. 13, 1994

[54] RE-BAR CLAMP ASSEMBLY

[76] Inventors: Richard Bechtel, 2530 Clairmont Dr., San Diego, Calif. 92117; Don Needham, 1518 Koe St., Lemon Grove, Calif. 92045

[ * ] Notice: The portion of the term of this patent subsequent to Aug. 13, 2007 has been disclaimed.

[21] Appl. No.: 129,536

[22] Filed: Dec. 7, 1987

[51] Int. Cl.[5] ..... E04C 3/02

[52] U.S. Cl. ..... 52/686; 248/229; 403/397; 52/719

[58] Field of Search ..... 52/677, 689, 719, 686, 52/678, 687; 248/231.8, 229, 316.7, 540; 403/397, 385; 24/335, 336, 339, 341

[56] References Cited

U.S. PATENT DOCUMENTS

| | | | |
|---|---|---|---|
| 1,278,437 | 9/1918 | Collings | 52/686 |
| 2,945,713 | 7/1960 | Sears | 403/385 X |
| 3,673,753 | 7/1972 | Anderson | 52/686 X |
| 4,610,122 | 9/1986 | DeClercq | 52/719 |
| 4,688,961 | 8/1987 | Shioda et al. | 403/397 X |

FOREIGN PATENT DOCUMENTS

| | | | |
|---|---|---|---|
| 1484969 | 3/1969 | Germany | 52/687 |
| 2554311 | 6/1977 | Germany | 52/684 |
| 7804649 | 10/1978 | Netherlands | 52/684 |

*Primary Examiner*—Carl D. Friedman
*Assistant Examiner*—Beth A. Aubrey
*Attorney, Agent, or Firm*—Gilliam, Duncan & Harms

[57] ABSTRACT

A re-bar clamp assembly for use in forming concrete footings that require the reinforcing steel rods to be spaced upwardly at a predetermined height above the ground so that when the concrete is poured into the footings the reinforcing bars will be completely encapsulated by the concrete. One of the forms of the re-bar clamp assembly is formed of a pair of first and second C-shaped clamps that are attached to each other in a stacked vertical orientation but with the open mouth of each clamp oriented substantially 90 degrees away from each other. Thus when the re-bars are snapped into the clamp assembly they will be oriented at 90 degrees to each other. A second form of the re-bar clamp assembly has a horizontally oriented C-shaped clamp that forms a slot for detachably curved finger extending re-bar steel rod. A resilient spring finger on the C-shaped clamp extends inwardly above the stake slot area and fictionally holds the clamp at any predetermined height on the stake.

8 Claims, 3 Drawing Sheets

RE-BAR CLAMP ASSEMBLY

BACKGROUND OF THE INVENTION

The invention relates to clamp assemblies and more specifically to clamp assemblies that are utilized for supporting re-bar steel rods that are used in concrete footings and walls.

Presently when concrete footings are formed the reinforcing steel rods are laid out in grid-like patterns and where they intersect, they are tied together with wire by a worker. This is a time consuming task that makes the operation costly. The re-bars have to be spaced upwardly from the bottom of the footing a predetermined height. It usually requires at least two workers working together in order to position the reinforcing bar steel rods at their proper height in the concrete footing. Usually small bricks are positioned under the re-bar to space it upwardly from the bottom of the footing. Sometimes the re-bar falls off the bricks making for additional problems.

It is an object of the invention to provide novel re-bar clamp assemblies that are quickly and easily snapped onto intersecting re-bar steel rods.

It is also an object of the invention to provide novel re-bar clamp assemblies that are economical to manufacture and market.

It is another object of the invention to provide novel re-bar clamp assemblies that reduce the time required to attach the re-bar steel rods to each other.

It is a further object of the invention to provide a novel re-bar clamp assemblies that eliminates the need for small bricks to space the re-bar steel rods in the footing upwardly a predetermined height above the bottom of the footing.

It is an additional object of the invention to provide a novel re-bar clamp assemblies that allows a single worker to set the re-bar steel rods in a footing at a predetermined height above the bottom of the footing by himself.

SUMMARY OF THE INVENTION

Applicants' novel re-bar clamp assemblies are used in footings and foundations containing reinforcing steel rods. One of the re-bar clamp assemblies is utilized at ninety degree intersections of the re-bars and they eliminate the task of tieing wire around the intersection point. All that is necessary for the worker to do, is to snap one re-bar into one of the C-shaped sections and snap the other crossing re-bar into the second C-shaped clamp struture. This allows a task that previously would take up to a minute to be completed in less than five seconds. Another advantage of this re-bar clamp assembly is that the intersecting steel reinforcing rods would not come into contact with each other thus eliminating a potential corrosion transfer point.

The second re-bar clamp assembly allows for the elimination of small blocks or bricks that are utilized to space the reinforcing steel rods upwardly a predetermined height above the bottom of the footing. With this new clamp assembly it would be merely necessary to drive a stake into the ground and to clamp the re-bar clamp assembly at a predetermined height on the stake. The upwardly curved finger extending outwardly from the clamp assembly forms a receptacle for supporting horizontally extending re-bar steel rods. Once the concrete has been poured into the footing or slab area the stakes can be removed. A forward movement on the stake allows the device to disengage itself from the stake which is then easily removed. The vertically oriented rib extending laterally from the re-bar clamp assembly functions to stabilize the position of the re-bar clamp assembly in the poured cement while the stake is being removed.

A third re-bar clamp assembly functions as a stand to support horizontally extending re-bar steel rods a predetermined height above the bottom of the footing. Fourth and fifth types of re-bar clamp assemblies are used to clamp vertically extending re-bar rods to horizontally extending form boards. The fourth type of re-bar clamp assembly uses a cam action to tighten the re-bar agaainst the form board and the fifth type of re-bar clamp assembly uses a wedge action to perform the same function.

DESCRIPTION OF THE PREFERRED EMBODIMENT

Figure 1:
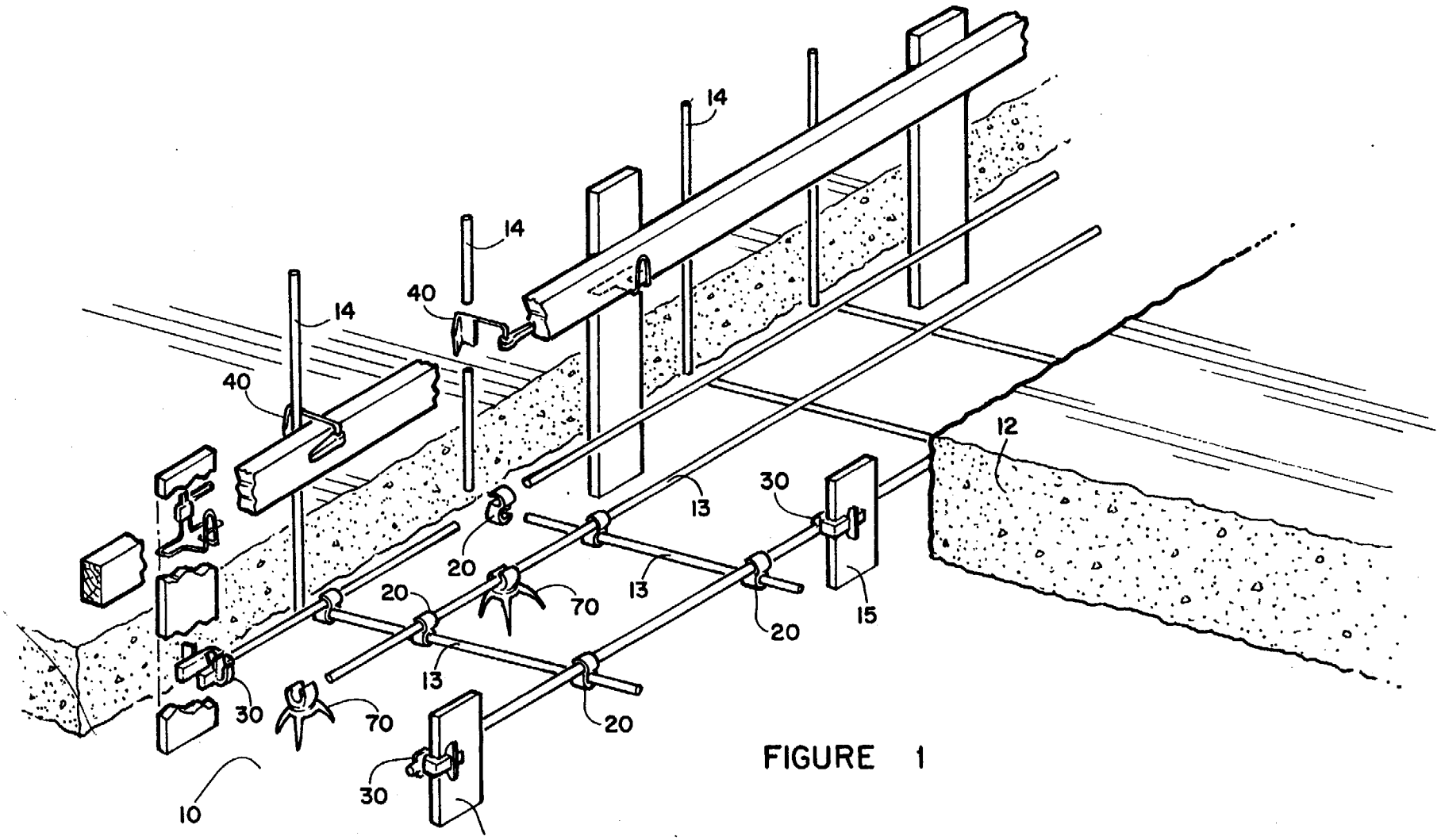
FIG. 1 is a perspective view illustrating the environment in which applicants' novel re-bar clamp assemblies are utilized.

Applicants' novel re-bar clamp assemblies will now be described by referring to FIGS. 1–6 of the drawings. In FIG. 1 an example of an application for the re-bar clamp assemblies is illustrated showing a ditch 10 that has been dug for a concrete footing in the ground 12. A plurality of horizontally extending re-bar steel bars 13 are layed out in a grid-like formation that intersect each other a ninety degree angles. Some of the re-bar rods have vertically extending portions 14. The horizontally intersecting re-bar rods are held in a fixed position by re-bar clamp assemblies 20. The re-bar clamp assemblies 30 are detachably secured on stakes 15 and they have a finger that supports the horizontally extending re-bar steel rods 13. Re-bar clamp assemblies 40 secure the vertical re-bars 14 against the horizontal form boards 17. Re-bar clamp assembly stands 60 support the re-bar steel bars 13 a predetermined height above the bottom of the footing.

Figure 2D:
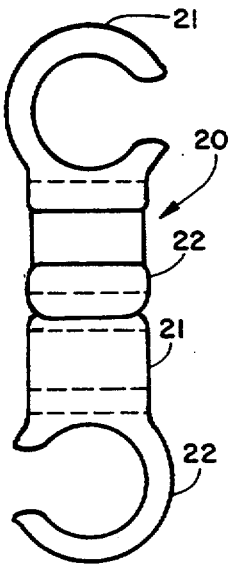
FIGS. 2–2*e* illustrate various views of different embodiments of applicant's novel re-bar clamp assembly.
Figure 2E:
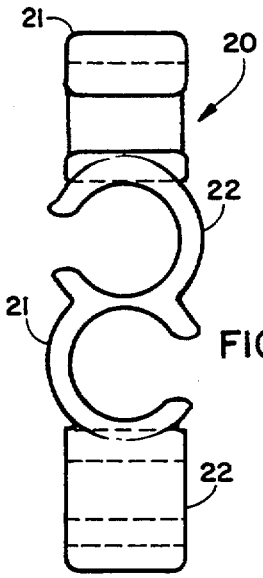
Figure 2B:
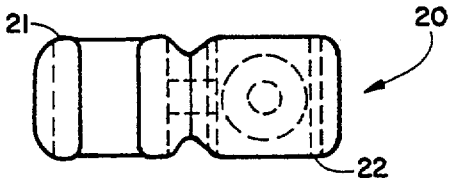
Figure 2A:
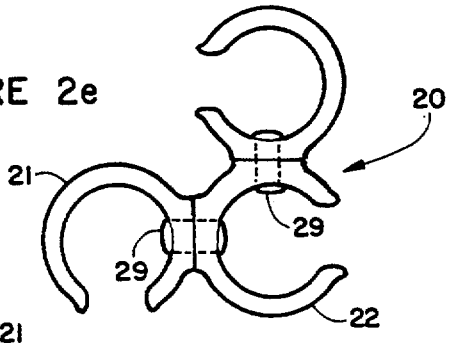
Figure 2:
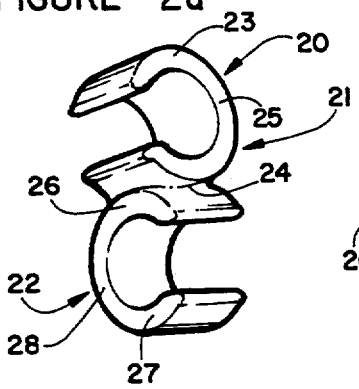
Figure 2C:
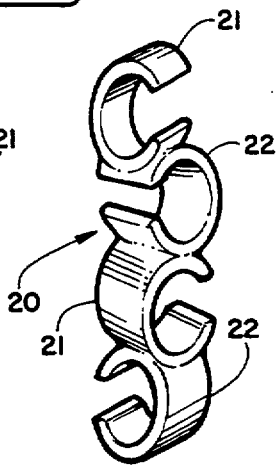
Figure 3C:
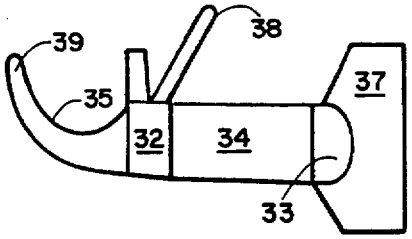
FIG. 3–3*c* illustrate various views of a second re-bar clamp assembly.
Figure 3B:
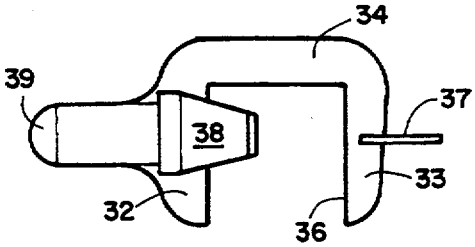
Figure 3A:
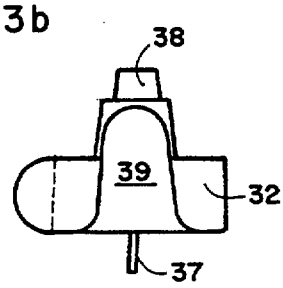
Figure 3:
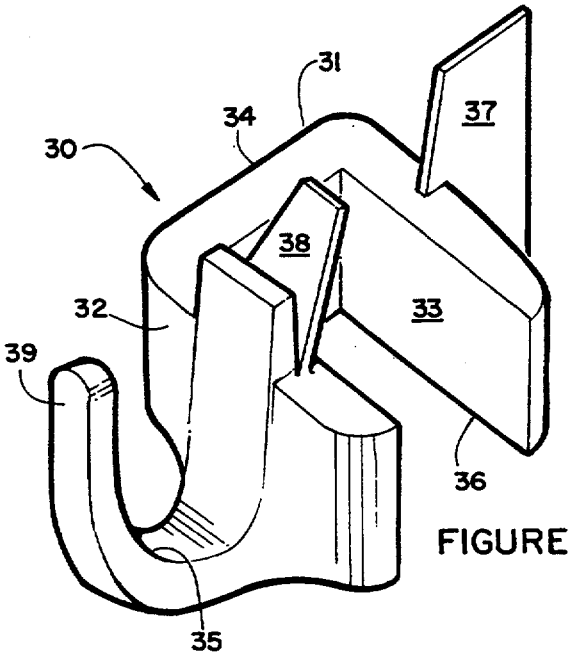

Re-bar clamp assembly 20 is best described by referring to FIG. 2. It is formed of two vertically stacked C-shaped clamps 21 and 22. C-shaped clamp 21 has a top arcuate portion 23, a bottom arcuate portion 24 and a vertical connecting portion 25. C-shaped clamp 22 has a top arcuate portion 26, a bottom arcuate portion 27 and vertical connecting portion 28. The open mouth of C-shaped clamp 21 is oriented to face substantially ninety degrees away from the open mouth of C-shaped clamp 22. The re-bar clamp assembly 20 is preferrably made of plastic material having sufficient resiliency to allow the open mouth portions of the respective C-shaped clamps to spring open enough to receive re-bar steel rods and then to clamp shut around them. A first alternative form of structure 20' would have a swivel structure 29 connecting two or more vertically stacked C-shaped clamps such as illustrated in FIG. *2a*. FIG. *2b* is a front elevation view of FIG. *2a*. A second alternative form of structure 20" is illustrated in FIGS. *2c–2e*. Structure 20" is formed of two vertically stacked C-shaped clamps 20.

Re-bar clamp assembly 30 is best described by referring to FIGS. *3–3c*. It is formed from a horizontally oriented C-shaped clamp 31 having a front wall 32, a rear wall 33 and a side wall 34. A slot 36 is formed between the front and rear walls for receiving the vertically oriented stake. A resilient spring finger 38 extends inwardly and provides a pressure force structure for holding the clamp assembly at a predetermined height on the stake. An upwardly curved finger 39 extends outwardly from front wall 32 and it has an arcuate resting portion 35 in its interior. A vertical stabilizer rib 37 is connected to rear wall 33. Horizontally oriented re-bar steel rods 13 are supported in these fingers.

Figure 4:
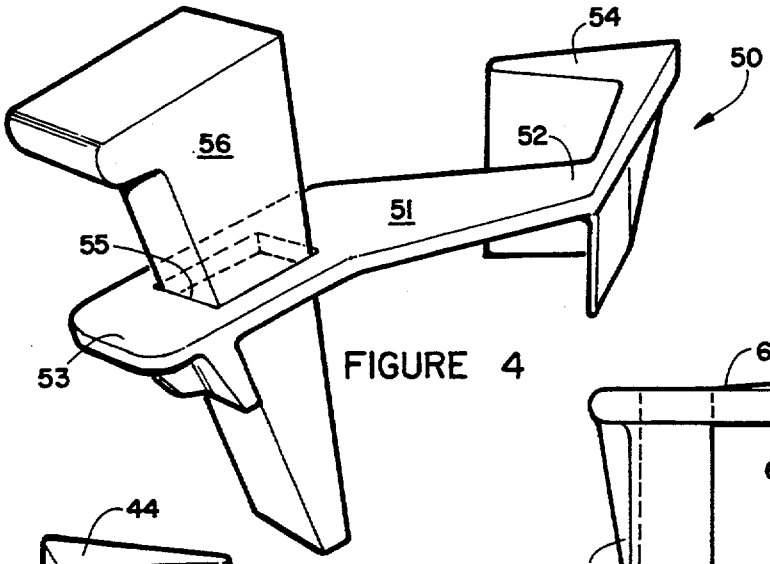
FIG. 4 is a perspective view illustrating another re-bar clamp assembly used for connecting vertical re-bar to horizontal form boards.
Figure 6:
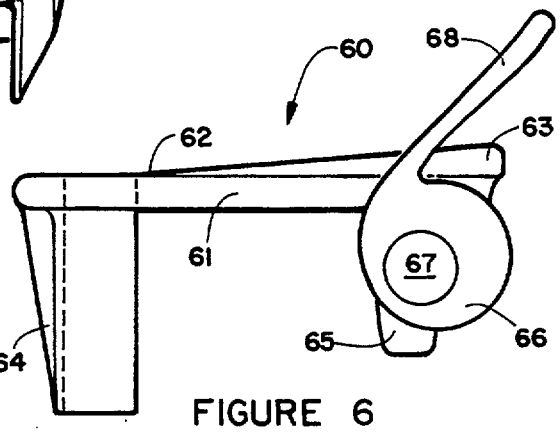
FIG. 6 is a perspective view of a third re-bar clamp assembly for attaching vertical re-bar to horizontally extending form boards.
Figure 5:
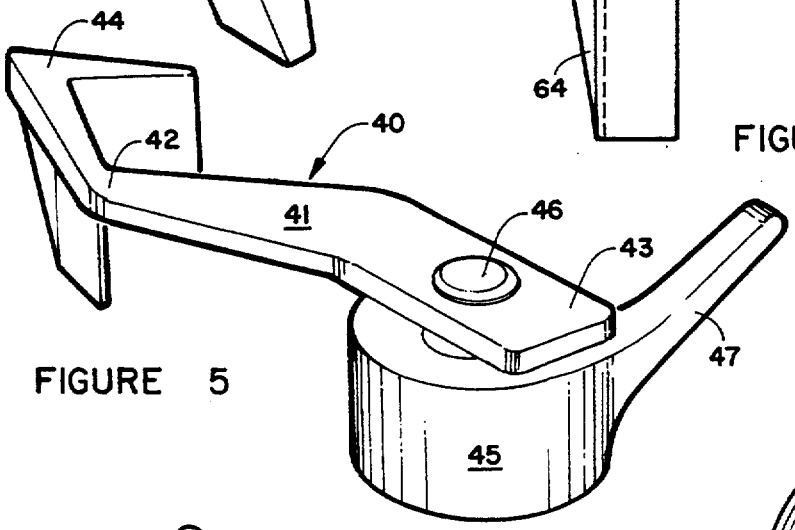
FIG. 5 is a side elevation view of a second re-bar clamp assembly for attaching vertical re-bar to horizontally extending form boards.
Figure 7B:
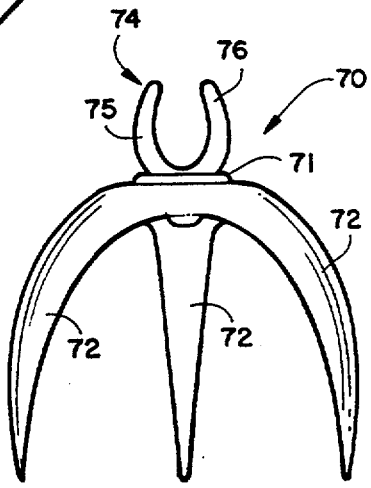
FIGS. 7, 7*a*, and 7*b* illustrate a third re-bar clamp assembly.
Figure 7A:
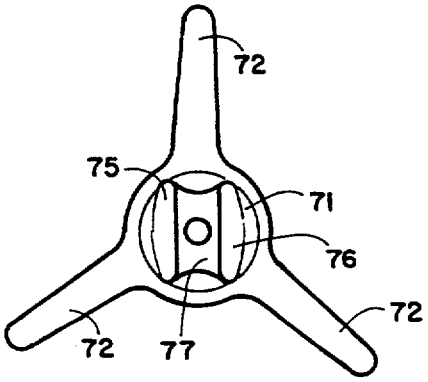
Figure 7:
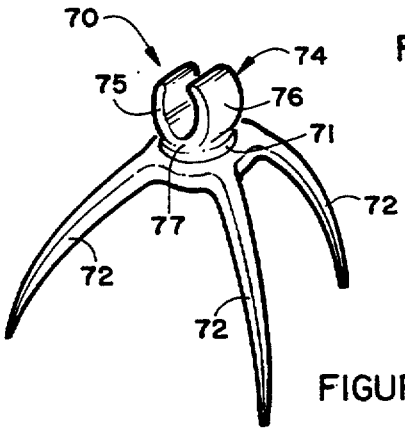

Re-bar clamp assembly 50 is illustrated in FIG. 4. It is used to secure vertically oriented re-bar steel rods 14 to the horizontally extending form boards 17. Re-bar clamp assembly 50 has an elongated horizontally extending arm 51 having a front end 52 and a rear end 53. A hook portion 54 is formed adjacent front end 52 for capturing vertically extending re-bar 14, A slot 55 is in arm 51 adjacent its rear end and it receives a wedge 56 which squeezes re-bar 14 into rigid contact with form board 17.

The re-bar clamp assemblies 40 and 60 are used for the same job as re-bar clamp assembly 50 but they utilize a camming action to tighten the re-bar steel rods against form board 17. Clamp assembly 40 has an elongated horizontally extending arm 41 having a front end 42 and a rear end 43. A hook portion 44 is formed adjacent front end 42 for capturing vertically extending re-bar 14. A cam member 45 is pivotally secured to the rear end 43 by a pin 46. A handle 47 is used to pivot cam member 45 about its vertical axis.

Re-bar clamp assembly 60 has an elongated horizontally extending arm 61 having a front end 62 and a rear end 63. A hook portion 64 is formed adjacent front end 62. A leg 65 extends downwardly from rear end 63 and it has a cam member 66 pivoted about a horizontal axis pin 67. Handle 68 is used to operate cam member 66 from its open position to its closed position.

A re-bar clamp assembly 70 is illustrated in FIGS. *7–7b*. It functions to support the re-bar steel rods 13 a predetermined height above the ground. Clamp assembly 70 has a platform 71 having a plurality of support legs 72 extending downwardly therefrom. A C-shaped clamp 74 is mounted on platform 71. C-shaped clamp 74 has arcurate portions 75 and 76 formed on opposite ends of connecting member 77. The open mouth of C-shaped clamp faces upwardly to receive re-bar 13 which is snapped therein.

What is claimed is:

1. A re-bar clamp assembly comprising:

a first C-shaped clamp having a top arcuate portion, a bottom arcuate portion, and a vertical connecting portion;

a second C-shaped clamp having a top arcuate portion, a bottom arcuate portion, and a vertical connecting portion; and means connecting the bottom arcuate portion of said first C-shaped clamp to the top arcuate portion of said second C-shaped clamp so that the open mouth of each of said clamps is oriented substantially 90 degrees away from each other.

2. A re-bar clamp assemby as recited in claim 1 wherein said first and second C-shaped clamps are made of plastic material and they are integrally formed as a single member.

3. A re-bar clamp assembly as recited in claim 1 wherein said means connecting the bottom arcuate portion of said first C-shaped clamp to the arcuate portion of said second C-shaped clamp is a swivel which allows said open mouths to swivel toward and away from each other.

4. A re-bar assembly as recited in claim 1 wherein said means connecting the bottom arcuate portion of said first C-shaped clamp to the top arcuate portion of said second C-shaped clamp fixedly connects said clamps together.

5. A re-bar assembly as recited in claim 1 additionally comprising a third C-shaped clamp having a top arcuate portion, a bottom portion, a vertical portion, and an open mouth and connection means for connecting the bottom portion of said third C-shaped clamp to the vertical portion of one of said first and second C-shaped clamps.

6. A re-bar assembly as recited in claim 5 wherein said connecting means fixedly positions said third C-shaped clamp to the connected one of said second and third C-shaped clamps.

7. A re-bar assembly as recited in claim 5 wherein said connecting means rotatably positions said third C-shaped clamp and the to one of said first and second C-shaped clamps.

8. A re-bar assembly as recited in claim 5 wherein said open mouth of said third C-shaped clamp is orientated 90 degrees from the open mouths of said first and second C-shaped clamps.

* * * * *